US006586052B2

(12) United States Patent
Creech et al.

(10) Patent No.: US 6,586,052 B2
(45) Date of Patent: Jul. 1, 2003

(54) METHOD FOR COATING INTERNAL SURFACES

(75) Inventors: George Edward Creech, Indianapolis, IN (US); Kevin E. Garing, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 09/960,430

(22) Filed: Sep. 21, 2001

(65) Prior Publication Data

US 2003/0059542 A1 Mar. 27, 2003

(51) Int. Cl.[7] ..... B05D 3/02; B05D 7/22

(52) U.S. Cl. ..... 427/376.1; 427/239; 427/376.2; 427/376.6

(58) Field of Search ..... 427/376.1, 376.2, 427/376.6, 239

(56) References Cited

U.S. PATENT DOCUMENTS

| | | | | |
|---|---|---|---|---|
| 4,009,146 A | | 2/1977 | Cork et al. | 260/42 |
| 4,031,274 A | | 6/1977 | Bessen | 427/229 |
| 4,145,481 A | | 3/1979 | Cupta et al. | 428/678 |
| RE31,339 E | | 8/1983 | Dardi et al. | 428/678 |
| 4,500,364 A | * | 2/1985 | Krutenat | 148/242 |
| 5,057,196 A | | 10/1991 | Creech et al. | 204/181.5 |
| 5,366,765 A | * | 11/1994 | Milaniak et al. | 427/229 |
| 5,482,578 A | | 1/1996 | Rose et al. | 148/516 |
| 5,624,721 A | * | 4/1997 | Strangman | 427/237 |
| 5,788,823 A | | 8/1998 | Warnes et al. | 205/192 |
| 5,824,366 A | | 10/1998 | Bose et al. | 427/239 |
| 5,958,204 A | * | 9/1999 | Creech et al. | 148/518 |
| 5,976,337 A | | 11/1999 | Korinko et al. | 204/487 |

FOREIGN PATENT DOCUMENTS

| | | |
|---|---|---|
| JP | 55118973 | 3/1979 |

* cited by examiner

*Primary Examiner*—Michael Barr
(74) *Attorney, Agent, or Firm*—Woodard, Emhardt, Moriarty, McNett & Henry LLP

(57) ABSTRACT

A method for coating a nickel- or cobalt-based superalloy surface by slurry deposition/heat diffusion. The method includes preparing a slurry of a metal coating powder mixed into an adhesive carrier that will burn off ash-free during a diffusion cycle, depositing the slurry onto the surface of a Ni- or Co-based superalloy material to form a coated surface, and heating the coated surface to a temperature of at least about 1600° F. to diffuse the metal coating powder into the metal substrate.

13 Claims, 2 Drawing Sheets

METHOD FOR COATING INTERNAL SURFACES

FIELD OF THE INVENTION

The present invention relates generally to coatings for superalloys such as nickel-based superalloys, and more particularly to a method for coating the internal surfaces of complex, superalloy parts.

BACKGROUND OF THE INVENTION

Nickel- and/or cobalt-based superalloys effective for use in high temperature environments are commonly used by the aerospace and power industries. While such alloys are inherently strong, they are generally not particularly resistant to corrosion by high temperature gases. Corrosion and oxidation-resistant coatings are therefore often applied to the metal to improve durability.

Internal coatings to protect those superalloy parts can be applied by several different methods. For example, chemical vapor deposition (CVD) methods using a reactor to generate a reactive Al-bearing species, or CVD methods that use above-the-pack technology, have been used. Both methods are generally effective, but require a sizable investment in equipment, etc. Moreover, in the case of above-the-pack processes, there is a significant amount of waste generated, including corrosive gases that require scrubbers to capture active species and/or convert them to innocuous products.

As an alternative to CVD methods, slurry methods have also been used. In those methods, an Al-bearing material is injected into the internal cavity and the part is heated to either produce an Al-bearing vapor and/or to diffuse the Al-bearing species into the metal surface.

One concern when using slurry methods is the amount of residue left after heat treating the component to diffuse the active species into the internal surface. Slurries that often contain halide activators also present additional problems since even trace amounts of these halides may initiate corrosion if not removed from the metal. Additional cleaning steps increase processing costs.

In addition, slurry methods often are difficult to use when the part being coated has small interior spaces. The slurry coating material doesn't always penetrate such spaces very effectively, and may leave some interior crevices uncoated.

Moreover, the coating methods of the prior art often make it difficult to control coating thickness. As a result, the interior coating may be thicker or thinner than necessary, adding weight and cost when the coating is too thick, and reducing coating efficacy when the coating is too thin.

A need therefore exists for new methods of applying a coating composition to Ni- and Co-based superalloy surfaces, and particularly to the inside of a jet engine turbine blade or vane. The present invention addresses that need.

SUMMARY OF THE INVENTION

Briefly describing one aspect of the present invention, there is provided a method for coating a nickel- or cobalt-based superalloy surface by slurry deposition followed by heat diffusion. The method comprises: (1) preparing a slurry of a metal coating powder mixed into an adhesive carrier that will burn off ash-free during a diffusion cycle; (2) depositing said slurry onto the surface of a Ni- or Co-based superalloy material to form a coated surface; and (3) heating said coated surface to a temperature of at least about 1600° F. to diffuse the metal coating powder into the metal substrate.

One object of the present invention is to provide an improved method of depositing a metal coating composition onto a superalloy surface.

Other objects and advantages will be apparent from the following description of the preferred embodiments.

DESCRIPTION OF THE PREFERRED EMBODIMENTS

Figure 2:
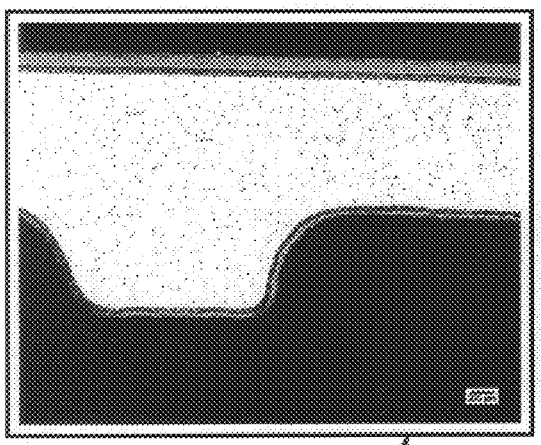
FIGS. 2–6 are enlarged views of portions of the turbine blade of FIG. 1, with the number of each figure corresponding to the reference numbers shown in FIG. 1.
Figure 3:
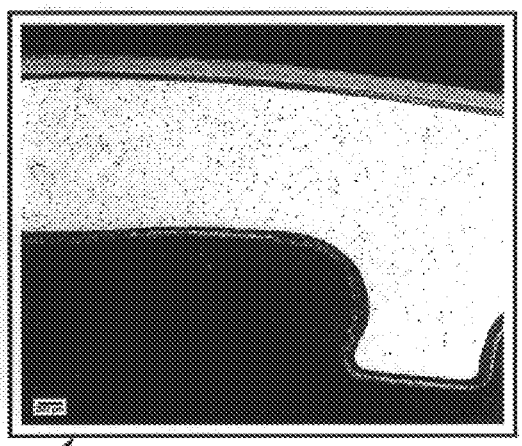
Figure 1:
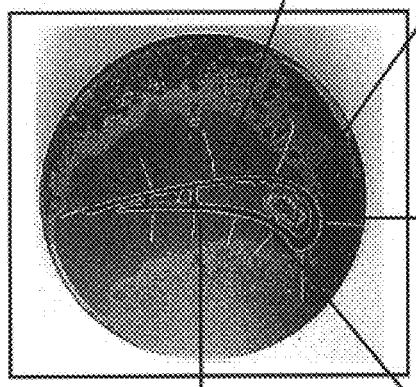
FIG. 1 is a section view of a turbine blade that has been coated with the technology of the present invention.
Figure 4:
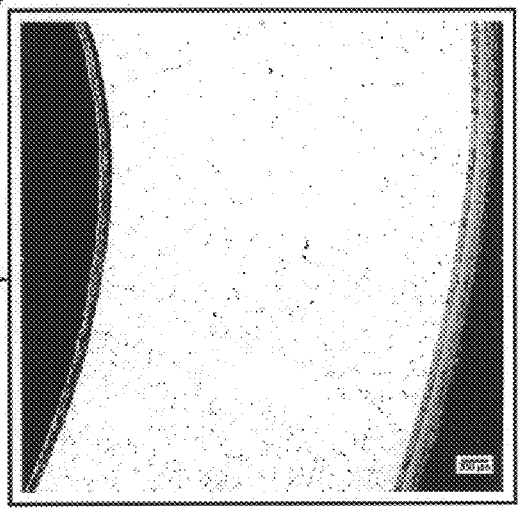
Figure 5:
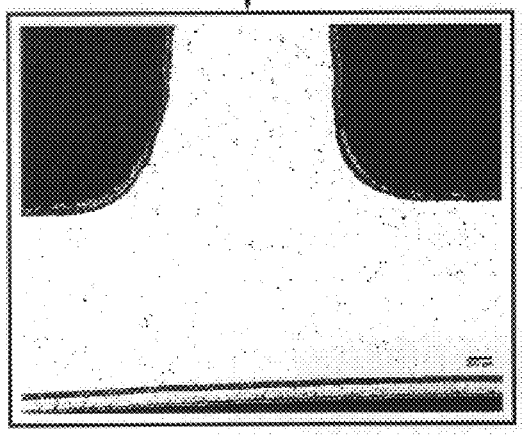
Figure 6:
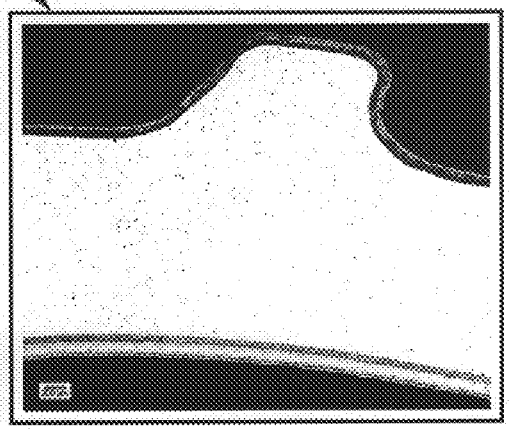

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated above, the present invention finds its primary utility as a method of coating the internal surfaces of turbine blades or other parts made of superalloys such as Ni- and/or Co-based superalloys. The preferred embodiments of the inventive method comprise: (1) preparing a slurry of a metal coating powder mixed into an adhesive carrier that will burn off ash-free when the coating is heated during the diffusion cycle; (2) depositing the slurry onto the surface of a superalloy material; and (3) heating the coated surface to a temperature of at least about 1600° F. to diffuse the coating into the surface while vaporizing the adhesive carrier. Among the primary advantages of the inventive method are the reduced need for post-coating cleaning, lower cost application, and better control over the coating thickness.

More particularly describing the preferred embodiments, the metal substrates that can be coated with the inventive method include any superalloy substrate such as Ni-based or Co-based superalloys. In particular, equiaxed superalloys such as IN738 and IN792, directionally solidified alloys such as Mar-M247, and single crystal alloys such as CMSX-3 and CMSX-4, can be coated effectively with the methods of the present invention. Cobalt-based alloys such as Mar-M509 and X-40 may also be used.

As to the coating composition itself, there are preferably two components in the coating composition. First, a metal coating material such as an aluminum-bearing or platinum-bearing material, either singly or in combination, is included. Second, an adhesive carrier such as a polystyrene glue is used to suspend the material in the mixture and hold the metal coating material on the metallic substrate until the coating can be diffused into the substrate.

The metal coating material can be any material that can effectively be used to coat superalloys such as Ni- or Co-based superalloy materials. Examples include mixtures of elemental and/or alloy powders containing aluminum, platinum, silicon, chromium, manganese, and palladium, either individually or in combination. Diffusion of powders to produce simple aluminides and Pt-aluminides have been preferred for coating turbine blades in testing done to date.

As to the amounts of each metal in the metal containing component, broad ranges of the various components (e.g., Pt, Pd, Si, Cr, Al, etc.) may be used as would be appreciated by persons skilled in the art of coating such superalloys. Generally, Pt and Pd is preferably present in an amount ranging from about 0% to about 95%, Si is preferably present in an amount ranging from about 0% to about 30%, Cr is preferably present in an amount ranging from about 0% to about 45%, and Al is preferably present in an amount ranging from about 0% to about 95%.

By way of further example, one embodiment uses 40–80% (by weight of the total metal) of a first powder comprising 85–100% Pt and up to about 15% Si, and 20–60% of a second powder comprising 50–75% Al and 25–50% Cr. All percentages are listed herein weight percentages unless specified otherwise. A second embodiment of the present invention uses that same 40–80% of a first powder comprising 85–100% Pt and up to 15% Si, and that same 20–60% of a second powder comprising 50–75% Al and 25–50% Cr, and additionally up to 40% of a third powder comprising 95–100% Al.

In a third embodiment of the present invention the green coating composition comprises 40–80% of a first powder comprising 85–100% Pt and up to about 15% Si, and 20–60% of a second powder comprising 35–45% Al, 35–45% Cr, and 10–30% Mn. A fourth embodiment uses 40–80% of a first powder comprising 85–100% Pt and up to about 15% Si, and 20–60% of a second powder comprising 35–45% Al, 35–45% Cr, and 10–30% Mn, and additionally adds up to 40% of a third powder comprising 95–100% Al.

A fifth embodiment of the present invention uses a metal coating powder that comprises 50–80% of a first powder comprising 85–100% Pt and 0–15% Si, and 20–50% of a second powder comprising 95–100% Al.

A sixth embodiment of the present invention uses a metal powder that comprises 60–80% of a first powder comprising 65–75% Al and 25–35% Cr, and 20–40% of a second powder comprising 95–100% Si.

In alternative embodiments, a portion or all of the platinum in the first powder composition can be replaced by other noble metals, for example, palladium, ruthenium, and rhodium. Alternatively, the first powder, the second powder, or the third powder can include up to about 5% Hf, Y, La or mixtures thereof. Further, in any of the embodiments described above, the green coating composition can include up to about 5% of a fourth powder comprising Hf, Y, or La or mixtures thereof, regardless of the mode of incorporation.

As to the carrier/adhesive, the adhesive is a material that holds the metal bearing component on the substrate until the metal coating powder can be diffused into the substrate, yet vaporizes leaving no contaminating residue when exposed to the temperatures at which diffusion occurs (typically, temperatures above about 1600° F.). In the most preferred embodiments the adhesive carrier is thixatropic so that it flows easily into small spaces when injected into the interior of a turbine blade under pressure, yet forms a thick gel on the substrate surface to provide adequate coating thickness. For example, polystyrene adhesives such as Testor's 3501, or urethane oligomer/(meth)acrylate monomer blends such as Multi-Cure 29615®, Multi-Cure #702, and Multi-Cure #706 (all available from Dymax Corporation), have been used effectively in testing to date.

The relative amounts of the metal material and the carrier/adhesive can vary from about 2:98 metal:adhesive, to about 50:50. Preferably the coating material comprises about 5–30% metal and about 70–95% adhesive. Most preferably about 10–25% metal and about 75–90% adhesive is used in the coating. The two components are preferably mixed to form a coating slurry which can be applied to the substrate.

As to the methods to be used for applying the coating composition, it is generally desirable to clean all metal surfaces prior to applying the coating slurry. For new turbine components, a short pickling in an acid, such as nitric acid, or ASC-2N (a proprietary formulation from Alloy Surfaces) stripper is normally adequate to remove any thin oxide film, etc. Surface oxides or contaminants can prevent the Al bearing material or vapor from diffusing into the internal surfaces of the component. For engine run hardware more aggressive cleaning measures such as fluoride ion cleaning (FIC) or strong alkaline cleaning agents such as hot potassium hydroxide in an autoclave or a mixture of hydrofluoric and nitric acids, is necessary to remove any surface oxides and other contaminants in order to prepare the surfaces for coating.

After the initial cleaning, a variety of methods generally known to the art can be used to apply the coating slurry. For example, the coating may be injected into interior spaces using slurry injection techniques, and may be painted, sprayed, or dipped onto exterior surfaces.

Once the slurry is applied the coating is cured. Curing using UV light and/or above-room-temperature heating cycles may be used, depending on the carrier resin.

After curing, the coated substrate is heated to diffuse the coating into the substrate surface. Typically the diffusion heat treatment used to diffuse the external coating can be used also to diffuse the slurry applied coating simultaneously. This eliminates the need for multiple diffusion heat treatment cycles.

In one embodiment, a slurry-applied internal coating and an aluminide external coating are diffused simultaneously on turbine components using a single heat treatment cycle of at least 1600° F. A preferred single step cycle of about 1850° F. to about 2080° F. and a time of about one to eight hours may be used to diffuse both coatings.

In alternative embodiments the slurry may be diffused into the substrate by a sequential multi-stage heating process to diffuse the powdered coating compositions into the substrate. In the first heating stage the powdered metal is preferably heated until it forms a transient liquid phase on the metal substrate. To accomplish that, it is generally preferred to first heat the coated substrate to a temperature of about 900–1,600° F. for about 0.25 to 2 hours. More preferably, the non-diffused coated substrate is subjected to a first heat diffusion treatment of about 1,100 to about 1,400° F. for about 0.25 hours to about 2 hours.

In the second heating stage the coated substrate is heated sufficiently to diffuse the coating into the substrate. Typically, the temperature is raised from the first stage to the second stage in the furnace. Generally, a temperature of about 1,600–2,100° F. and a heating time of one to eight hours is effective for that stage. More preferably, the second heating stage uses a temperature of about 1,850° F. to about 2,080° F. and a time of about one to eight hours.

In some preferred embodiments it is advantageous to use a pretreatment heating step as part of, or before, the first heating stage. With this method the first heating stage is preferably accomplished by heating the coated substrate to a first temperature of about 950° F. to about 1,150° F. for about 0.5 to about 1.0 hours.

It is to be appreciated that the multiple heating stages may be accomplished by "ramping" the temperature upward from the lower heat treatment temperature to the higher heat treatment temperature. With that technique, there may be no clear break between the first heating stage and the second heating stage, as the two stages run smoothly into each other.

The diffusion heat treatment is preferably accomplished in vacuum, hydrogen, argon, or other suitable furnace atmosphere.

In one preferred embodiment the green coated substrate is subjected to a pre-diffusion temperature of about 950° F. to about 1,150° F. for 0.5 to about 1 hour. Thereafter, the coated substrate is heated to about 1,200° F. to about 1,400° F. for about 1 hour and then to about 1,900° F. to about 1,975° F. for about 1 to about 8 hours.

After processing, the coated surface may be cleaned with a short ultrasonic cleaning step to remove any traces of the slurry mixture. Alternatively, a water jet cleaning step or a mild grit blast may be used to clean the coated surface and remove undiffused coating material.

One feature of the present invention is that the carrier/adhesive resin vaporizes leaving essentially no contaminating residue when heated to a temperature effective to diffuse the metal coating powder into the surface of the superalloy. For the purposes of this disclosure, "essentially no contaminating residue" shall mean that less than 0.1 wt % residue remains after the diffusion-heating step.

Reference will now be made to specific examples using the processes described above. It is to be understood that the examples are provided to more completely describe preferred embodiments, and that no limitation to the scope of the invention is intended thereby.

EXAMPLE 1

The external surfaces of a T56-A427 first stage turbine blade was first coated with a Pt/Al (XP-32) green coat by electrophoretic deposition. A slurry was prepared by mixing polystyrene glue (commercially available as Testors Cement 3501) and approximately 15 wt % of an Al/Cr/Mn powder (nominal wt % composition of 42Al:40Cr:18Mn) to produce a consistency suitable for injecting into the internal cavities of the blade. After cleaning with ASC-2N solution, the blade was injected with the metal-containing slurry. Both the external and internal coatings were diffused in the same stepped heat treatment (1100° F.—1 hr, 1225° F.—1 hr, 1925° F.—6 hr in vacuum) to form both the external and internal coatings simultaneously. After processing, the external surfaces were blasted lightly with 220 grit aluminum oxide to remove the excess bisque. A short (10 minute) ultrasonic cleaning step was used to remove any traces of slurry mixture internally. Weight changes after ultrasonic cleaning suggested minimal extraneous material remaining in the internal cavity of Blade S/N DBS985.

The coated blade is shown in FIGS. 1–6. As shown by those figures, the internal and external surfaces are both coated with good, uniform coatings. Moreover, the internal coating is thinner than the external coating, as is desired for this application. In particular, the average external PtAl coating thickness was 0.0034 inch, while the average internal aluminide coating thickness was 0.001 inch.

EXAMPLE 2

ASC-2N cleaned blades were first injected with a coating composition comprising an Al/Cr/Mn powder (nominal wt % composition of 42%Al:40%Cr:18%Mn) and Multi-Cure 29615®. The slurry composition was about 25:75 powder to adhesive. The coating was allowed to cure, and was then dry honed to remove any extraneous slurry from the trailing edge cooling slot. Following that, a coating of nominal wt % composition of 54%Pt:6%Si:31%Al:9%Cr (XP-33) was electrophoretically deposited on the external surfaces of the blade.

After subjecting the blades to a stepped heat treatment (1100° F.—1 hour, 1225° F.—1 hour, 1925° F.—8 hours) in hydrogen, metallographic examination revealed that this approach also produced acceptable results.

EXAMPLE 3

A slurry of polystyrene glue loaded with approximately 15 wt % of a XP-32 powder mixture (nominal wt % composition of 45%Pt:5%Si:30%Al:14%Cr:6%Mn) was prepared and injected into the internal cavity of a clean first stage turbine blade. The slurry composition was about 15:85 powder to adhesive. The internal coating was cured. A coating of the same composition was then deposited on the external surface electrophoretically. Both the external and internal coatings were diffused in a stepped heat treatment (1100° F.—1 hr, 1225° F.—1 hr, 1925° F.—6 hr in vacuum) to form both the external and internal coatings simultaneously. After processing, the external surfaces were blasted lightly with 220 grit aluminum oxide to remove the excess bisque. A short (10 minute) ultrasonic cleaning step was used to remove any traces of slurry mixture internally. Metallographic examination revealed similar results to Example 1.

EXAMPLE 4

Clean blades were injected with a coating composition comprising a Cr/Al/Mn alloy (nominally 42%Al:40%Cr:18%Mn) and Multi-Cure 29615®. The coating was allowed to cure, and was then dry honed to remove any extraneous slurry from the trailing edge cooling slot. Following that, a coating of nominal wt % composition of 54% Pt:6% Si:31% Al:9% Cr (XP-33) was electrophoretically deposited on the external surfaces of the blade.

The blades were heated in a stepped diffusion cycle to diffuse the coatings into the blade surfaces (1100° F.—1 hr, 1225° F.—1 hr, 1925° F.—8 hr in vacuum).

Metallographic examination revealed that the coatings were uniform and provided acceptable protection. The internal aluminide coating thickness was typically 0.001–0.0015", while the external PtAl thickness was typically 0.002".

EXAMPLE 5

Figure 7:
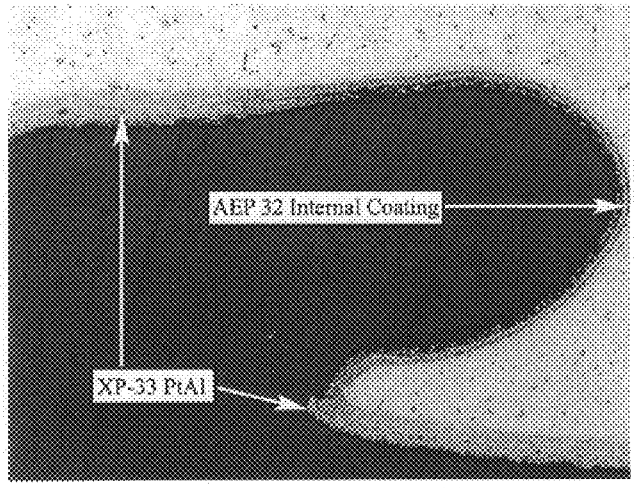
FIG. 7 is a view of the transition of the external PtAl coating into the internal aluminide coating at the cooling slot of a blade after 2000 cycle engine test with 150 hr at maximum power.
Figure 8:
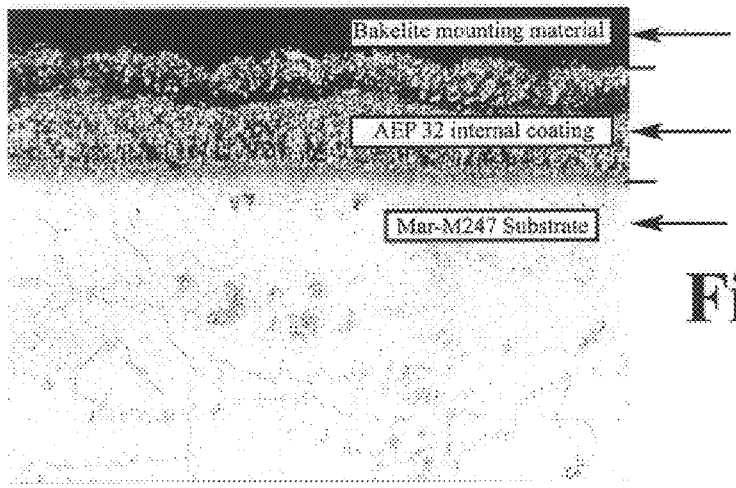
FIG. 8 is a view of the inventive internal aluminide coating on an internal concave surface, applied as described in Example 2 on blade at 10% span after 2000 cycle engine test with 150 hr at maximum power.
Figure 9:
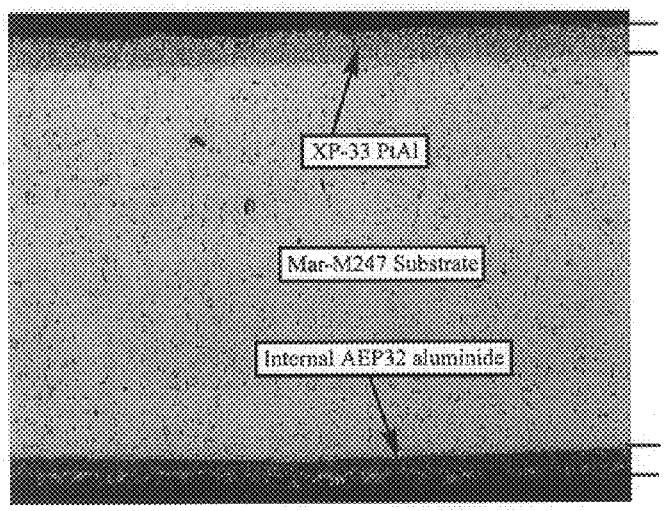
FIG. 9 is a low magnification view of the convex airfoil cross section showing the external PtAl coating and the internal aluminide coating on blade at 90% span after 2000 cycle engine test with 150 hr at maximum power.

Blade S/N DBS072 is a Stage 1 Model T56-A427 Turbine Blade that was processed per Example 2 and subjected to an engine test to determine the durability of both the external XP-33 PtAl coating and the inventive aluminide internal coating. Representative microphotographs of these coatings after 2000 cycles of testing with 150 hr at maximum power illustrate the durability of the coatings are shown in FIGS. 7–9.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of coating a superalloy surface, said method comprising: (1) preparing a slurry comprising a metal coating powder and a carrier/adhesive resin that vaporizes leaving essentially no contaminating residue when heated to a temperature effective to diffuse the metal coating powder into the surface of a superalloy material; wherein said carrier/adhesive resin is a urethane oligomer/(meth) acrylate monomer blend that vaporizes leaving no contaminating residue when heated to a temperature of about 1250° F.; (2) depositing said slurry onto the surface of a superalloy material to form a coated surface; (3) curing the coated surface; and (4) heating said coated surface to a temperature and for a time effective to diffuse the coating into the surface.

2. The method of claim 1 wherein said metal coating powder comprises an aluminum bearing coating powder.

3. The method of claim 2 wherein said aluminum bearing powder comprises an elemental aluminum powder.

4. The method of claim 2 wherein said aluminum bearing powder comprises a mixture of Pt—Si alloy, Al—Cr alloy, and elemental Al powder.

5. The method of claim 2 wherein said aluminum bearing powder comprises a mixture of Pd—Si alloy, Al—Cr alloy, and elemental Al powder.

6. The method of claim 2 wherein said aluminum bearing powder comprises an Al—Cr alloy powder.

7. The method of claim 2 wherein said aluminum bearing powder comprises a mixture of a Al—Cr alloy and elemental Si powder.

8. The method of claim 2 wherein said aluminum bearing powder comprises a Al—Cr—Mn alloy powder.

9. The method of claim 2 wherein said aluminum bearing powder comprises a mixture of powders in claims 3–8, singly or in combination of elemental or alloy powders.

10. The method of claim 1 wherein said superalloy surface is a nickel-based superalloy surface.

11. The method of claim 10 wherein said nickel-based superalloy surface is a single crystal superalloy surface.

12. The method of claim 1 wherein said superalloy surface is a cobalt-based superalloy surface.

13. The method of claim 1 wherein said superalloy surface is the interior surface of a jet engine turbine blade or vane.

* * * * *